US007641185B2

(12) United States Patent
Lyons et al.

(10) Patent No.: US 7,641,185 B2
(45) Date of Patent: Jan. 5, 2010

(54) VACUUM PICK MECHANISMS

(75) Inventors: Eric Lyons, Dundee (GB); John White, Motherwell (GB); Roy A. Crerar, Edinburgh (GB)

(73) Assignee: NCR Corporation, Dayton, OH (US)

( * ) Notice: Subject to any disclaimer, the term of this patent is extended or adjusted under 35 U.S.C. 154(b) by 247 days.

(21) Appl. No.: 11/315,889

(22) Filed: Dec. 22, 2005

(65) Prior Publication Data

US 2007/0145668 A1 Jun. 28, 2007

(51) Int. Cl.
*B65H 3/12* (2006.01)

(52) U.S. Cl. ..... 271/96; 271/107

(58) Field of Classification Search ..... 271/107, 271/108, 96
See application file for complete search history.

(56) References Cited

U.S. PATENT DOCUMENTS 4,513,957 A * 4/1985 Schaefer, Jr. ..... 271/90
4,957,283 A * 9/1990 Kist ..... 271/90
5,180,156 A * 1/1993 Matsui et al. ..... 271/103
5,431,384 A * 7/1995 Obermiller et al. ..... 271/11
5,719,383 A * 2/1998 Forrest ..... 235/379
6,349,930 B1 * 2/2002 Kruger et al. ..... 271/104
7,232,059 B2 * 6/2007 Peebles ..... 235/379
2005/0127162 A1 * 6/2005 Peebles ..... 235/379
2007/0205260 A1 * 9/2007 Tennant ..... 235/379

* cited by examiner

*Primary Examiner*—Patrick H Mackey
*Assistant Examiner*—Michael C McCullough
(74) *Attorney, Agent, or Firm*—Michael Chan

(57) ABSTRACT

A vacuum pick mechanism (100) for picking sheet media comprising control circuitry (126), a pump (110), a suction cup (106), a pick line (112) connecting the pump (110) to the suction cup (106), a pressure sensor (122) arranged to measure the pressure within the pick line (112) and a motor arranged to drive the pump, the control circuitry being arranged to receive the pressure measured by the pressure sensor and to control the motor to drive the pump such that a predetermined target pressure is measured by the pressure sensor.

2 Claims, 3 Drawing Sheets

VACUUM PICK MECHANISMS

TECHNICAL FIELD

This invention relates to vacuum pick mechanisms for handling media, in particular but not exclusively, sheet media such as currency notes.

BACKGROUND

Pick mechanisms for transferring sheet media are known and usually comprise one or more suction cups mounted on a pick means which comprises a pivoting arm and a tube (known as a pick line) opening into the suction cup. The pivoting arm brings the suction cup into contact with sheet media, and a pump is used to suck air through the pick line creating a partial vacuum. The suction cup is then moved away with the media sheet held thereto by suction.

Taking the example of an Automated Teller Machine (ATM), in which the sheet media comprises currency notes, most ATMs include a plurality of vacuum picking mechanisms so that different denominations of currency notes can be dispensed from stacks of notes of that denomination. In the UK, typically four modules are provided, two of which may be dedicated to picking from stacks of twenty-pound notes and the other two of which may be dedicated to picking from stacks of ten-pound notes.

The strength of the vacuum required may be calculated according to the media to be picked. Returning to the example of ATMs, a pump must be powerful enough to pick up one note from the front of a stack, but not so powerful that two notes are picked up. A key factor in how securely the note is held is the difference between the pressure within the cup and the local atmospheric pressure. At present, a vacuum is created according to predetermined criteria dependent on physical attributes of the currency and denomination with which the pick mechanism is intended to be used.

In prior art pick means, the pump is controlled to perform a predetermined number of strokes, or parts of a stroke depending on the pump, to produce the pressure, subject to local atmospheric variations, which it has been previously determined is suitable for picking the media types with which it is intended that the pick means be used. This may result in pick failure where, for example there is a hole in the sheet media through which air can ingress. Alternatively, the pressure may drop as the note is transported by the pick means and the sheet media may detach from the suction cup.

In order to create a reduction in pressure relative to atmospheric pressure, the volume of a sealed system may be increased. To halve the pressure, the volume must be doubled and therefore the volume in which the partial vacuum is created is preferably as small as possible. This means that a smaller pump can be used to achieve an acceptable picking time and/or the strokes made by a pump can be fewer or shorter. The benefit in creating a vacuum quickly is both in the speed with which media is picked up and handled and also in the likely success of a picking attempt. Creating a pressure difference quickly is more likely to 'suck' the media into firm contact with the suction cup and create a good initial seal.

SUMMARY

According to a first aspect of the present invention, there is provided a vacuum pick mechanism for picking sheet media comprising control circuitry, a pump, a suction cup, a pick line connecting the pump to the suction cup, a pressure sensor arranged to measure the pressure within the pick line and a motor arranged to drive the pump, the control circuitry being arranged to receive the pressure measured by the pressure sensor and to control the motor to drive the pump such that a predetermined target pressure is measured by the pressure sensor.

This is advantageous as the pick mechanism is therefore able to adapt to provide different pressures for picking media as required by selecting a new target pressure. Further, the pick means is able to respond if pressure is lost either due to an incomplete seal, a hole in the sheet media or seepage through the media. The pressure could be varied continuously as media is handled or adjusted periodically.

In one embodiment, the predetermined target pressure is determined according to characteristics of the sheet media with which the vacuum pick mechanism is intended to operate. The characteristics may be one or more of the following: density of media, substrate, weight of media, quality of media, dimensions or the like. Even considering a limited media type such as currency, there can be significant variations within a single currency type in terms of the sizes and weights of notes. Between different countries, differences in note type are more marked. For example, Japanese currency is shiny and resists separation by suction cups. US currency is more readily picked up by suction cups.

The predetermined target pressure may be determined according to one or more of the following: atmospheric pressure and/or the altitude at which the vacuum pick means is intended to operate. This is advantageous as the preferred target pressure represents a pressure difference with the atmosphere (i.e. a relative pressure) as opposed to an absolute pressure. Atmospheric pressure varies according to the weather and, significantly, according to altitude. It is preferable that the actual atmospheric pressure or average atmospheric pressure at the altitude at which a pick mechanism is intended to operate is taken into account.

In some embodiments, the pick mechanism may comprise an atmospheric pressure sensing means and/or an altimeter. This is advantageous as it allows the predetermined target to be achieved relative to atmosphere pressure and/or altitude without requiring an input to be made. Therefore a mechanism could adjust automatically to changes in atmospheric pressure.

In one embodiment, the line and an area of the pump provide a vacuum forming region and the mechanism comprises a fluid tight seal defining two portions therein, the portions comprising a pick side portion in communication with the suction cup and a pump side portion in fluid communication with the pump, the pick mechanism being arranged such that, in use of the mechanism and at the time of picking the sheet media, pressure is reduced in only the pick side portion.

In one embodiment, the fluid tight seal may comprise a moveable bung. In such embodiments, the pump side portion may be arranged to contain a liquid and the pick side portion is arranged to contain a gas. This is advantageous as liquids are generally less expandable than gases and therefore the pump can be used to draw the liquid in the pump side portion out of the pick means, moving the bung to increase the volume of the pick side portion. Although the pressure required to pick up and hold an item of sheet media is variable, in prior art relating to cash machines, the pressure is usually around half atmospheric pressure and therefore volume in which the partial vacuum is to be formed must be approximated doubled. As the pressure change is preferably made quickly, it is advantageous to keep the volume to be increased as small as possible.

In other embodiments, the moveable bung may comprise an air channel which is arranged to be sealed by the pick line but, when the bung is retracted into the cylinder, be open to allow air to pass there through. The air channel may comprise an elbow-shaped bore. Such a bung may be attached to a piston of the pump. This is advantageous as a partial vacuum may be formed and then, as the pump is operated past a predetermined point, the pressure automatically equalizes. As the pick line is generally narrow, almost capillary in nature, but the volume enclosed by a pump cylinder is comparatively large, this will happen very quickly.

In an alternative embodiment, the fluid tight seal comprises a valve which has an open state, in which the two portions are in fluid communication, and a closed state, wherein the valve is movable between the open state and the closed state and the control circuitry is arranged to control the state of the valve. This provides a convenient and versatile fluid tight seal.

Preferably, the control circuitry is arranged to generally control the state of the valve to be in its closed state and to control the pump to create and maintain a partial vacuum in one portion of the pick line and, in use of the mechanism and with the vacuum cup placed against a sheet media, to control the valve to its open state. This is advantageous as, on opening the valve, the pressure in the two portions will rapidly equalize and a suitable partial vacuum to pick up an item of sheet media will be created more quickly on demand than if the pump is operated once the suction cup is in contact with an item of sheet media to partially evacuate the whole of the pick line.

In one embodiment relating to Automated Teller Machines, the partial vacuum in the pump side portion may be created when a bank card is inserted into the machine. This is advantageous as the vacuum will not then be sustained over periods of time when the machine is not in use.

According to a second aspect of the present invention, there is provided an Automated Teller Machine comprising a plurality of vacuum pick mechanisms, each of said mechanisms comprising a pump.

As will be appreciated by the person skilled in the art, in prior art Automated teller Machines (ATMs), there is generally provided only one motor and one pump. This invention therefore partly lies in providing a pump for each mechanism, which allows the length, and therefore volume, of the pick line to be reduced when compared to prior art ATMs, allowing vacuums to be formed faster and with a less powerful pump than in prior art machines.

The pump may be driven by a stepper motor. This is advantageous as stepper motors are more easily controllable than other motors.

The stepper motor is controlled by the control circuitry to adjust the pressure during a pick action. This is advantageous as it provides an ATM which is capable of adjusting to correct problems during the pick action, such as loss of pressure due to holes in the sheet media, or the like.

The vacuum pick mechanism may be a vacuum pick mechanism according to the first aspect of the invention.

BRIEF DESCRIPTION OF THE DRAWINGS

Embodiments of the present invention will now be described, by way of example only, and with reference to the accompanying drawings, of which

DETAILED DESCRIPTION

Embodiments of the invention are further illustrated by Appendix 1, which comprises a set of equations illustrating the effects of altitude on a vacuum pick mechanism.

Figure 1:
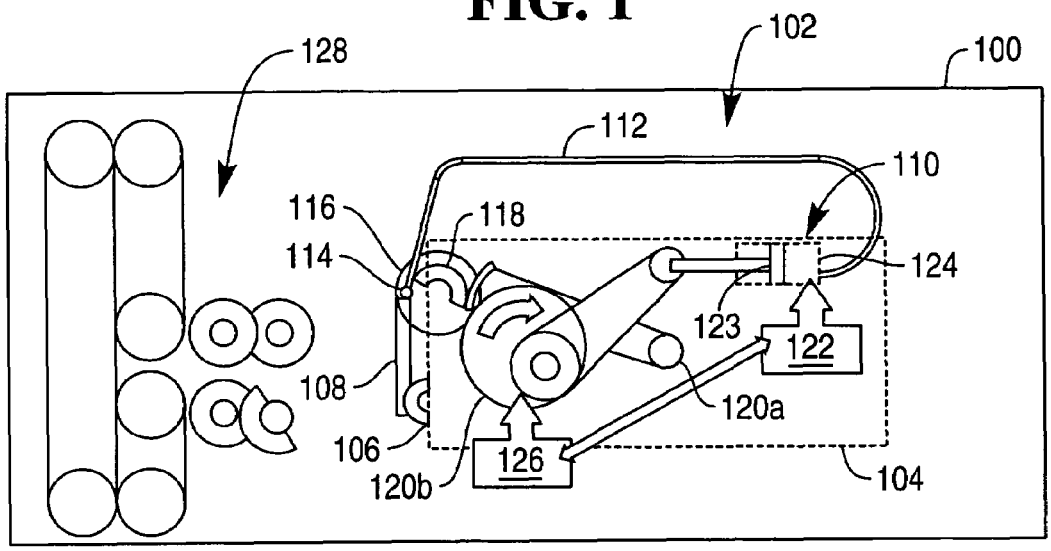
FIG. 1 shows a vacuum pick mechanism according to one embodiment of the present invention.

FIG. 1 shows one embodiment of a vacuum pick mechanism 100 for a cash machine comprising a pick means 102 arranged to pick currency notes held in a currency cassette 104, a pump 110, a pick arm motor 120*a*, a pump motor 120*b*, a pressure sensor 122 and control circuitry 126. The pick means 102 comprises a suction cup 106 which is mounted on a pivoting arm 108. The suction cup 106 is connected to the pump 110 via a pick line 112, which continues through a hole bored though the pivoting arm 108. The pivoting arm 108 is mounted eccentrically to a point 114 on a rotating disc 116, which comprises a gear section 118. The pump 110 and the rotating disc 116 are driven by the motors 120*a*, 120*b*, which are stepper motors controlled by the control circuitry 126.

The pump 110 comprises a piston 123 arrange to operate within a cylinder 124 and the pressure sensor 122 is arranged to determine the pressure within the cylinder 124 (which corresponds to the pressure in the pick line 112). The pressure sensor 122 is further arranged to pass the pressure reading to the control circuitry 126.

In use of the vacuum pick mechanism 100, the control circuitry 126 is supplied with a predetermined target pressure. This will be determined according to the media type to be dispensed (usually currency, so this will include a consideration of the note type in that country, the denomination that the mechanism 100 is expected to dispense). The predetermined target pressure will represent an appropriate difference from the local atmospheric pressure.

When an item of sheet media is requested, the pick arm motor 120*a* drives the gear portion 118 on the rotating disc 116, causing the point 114 at which the pivoting arm 108 is held to move such that the suction cup 106 is brought into contact with the front most sheet in a stack of sheets stored in the currency cassette 104. The control circuitry then causes the pump motor 120*b* to control the pump 110 which partially evacuates the pick line 112 and the volume enclosed between the suction cup 106 and the sheet. The pressure reached in the pump cylinder 124 is monitored by the pressure sensor 122 and is passed to the control circuitry 126. When the predetermined target pressure is reached, the control circuitry 126 stops the pump motor 120*b* and controls pick arm motor 102*a* to drive the gear portion 118 on the rotating disc 116, which moves the suction cup 106 away from the cash tray 104 with the front most sheet held thereto by suction.

During transportation by the pick means 102, the pressure in the cylinder 124 is monitored by the pressure sensor 122. If the pressure falls below the predetermined target pressure, the control circuitry 126 controls the pump 110 to operate to increase the pressure. Drops in pressure may, for example, be due to an incomplete seal between the suction cup 106 and the sheet, to air seeping through the sheet or to a hole in the sheet.

The pressure changes displayed during transportation of the sheet may be recorded by the control circuitry and used to build a leakage pattern associated with that type of media. This can then be used to determine future target pressures.

The sheet is then transported into a transfer mechanism 128 and carried away in order to be dispensed to a user of the cash machine.

Figure 2:
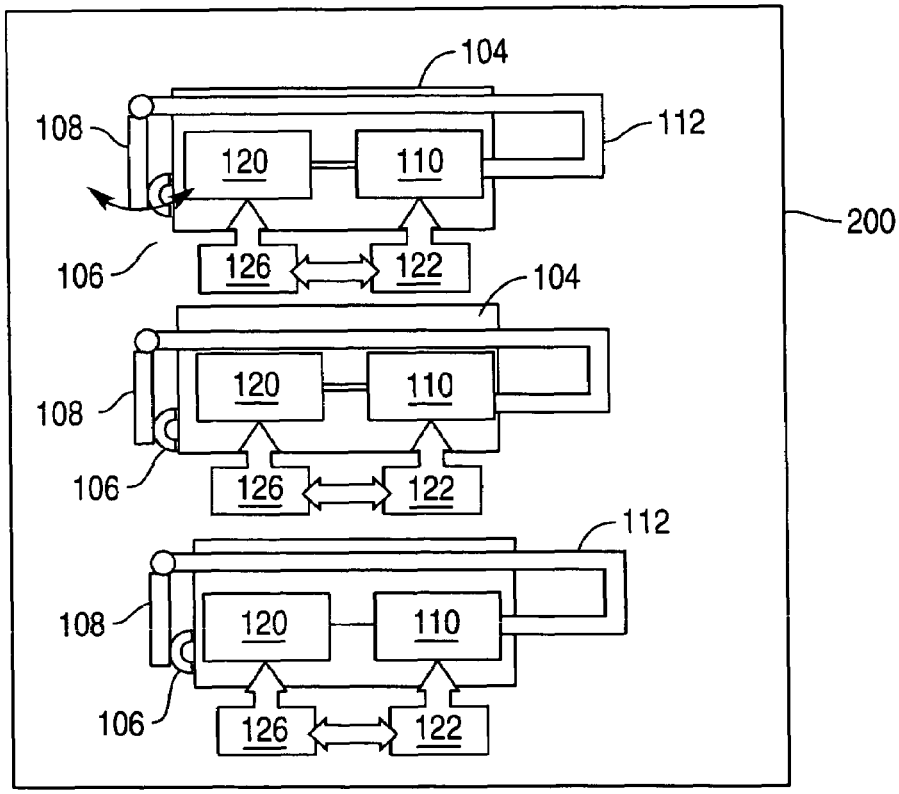
FIG. 2 shows a pick unit comprising three vacuum pick mechanisms operated by pumps.

A second embodiment is now described which comprises reducing the 'dead volume', i.e. that volume between the piston 123 and the suction cup 106. Although as discussed above, the pressure required to pick up and hold an example of sheet media is variable, in prior art relating to cash machines, the pressure is usually around half atmospheric pressure and therefore volume in which the partial vacuum is to be formed must be approximated doubled. This volume is preferably reduced by situating the pump 110 close to the suction cup 106. This is achieved, as shown in FIG. 2, by providing a pick unit 200, in this case comprising three pick mechanisms 100 in place of the prior art single mechanism.

Figures 3, 3A:
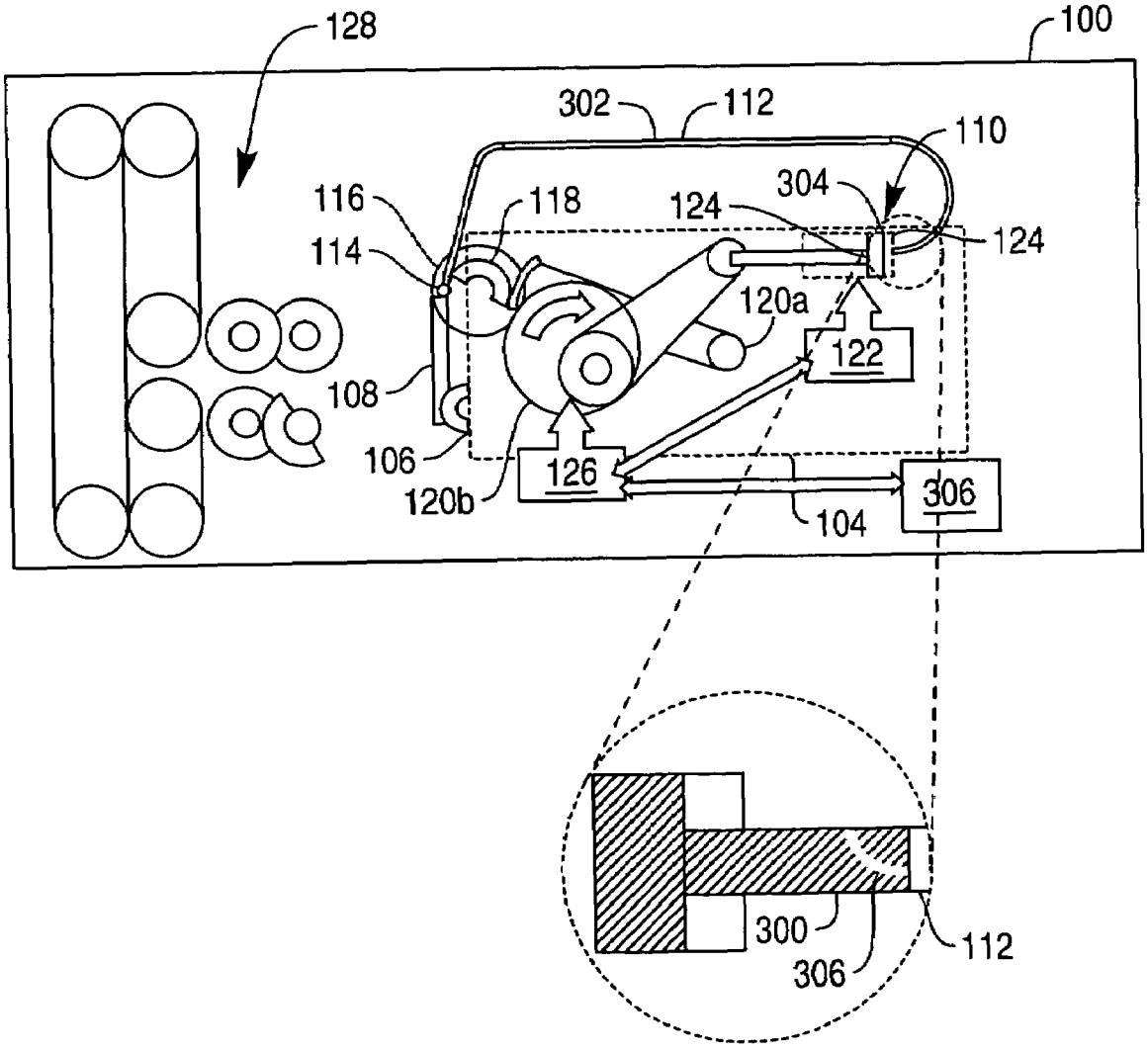
FIG. 3 shows a vacuum pick mechanism according to a second embodiment of the present invention.

In an alternative embodiment, as shown in FIG. 3 (where features in common with those described in relation to FIG. 1 are labeled with like numbers), the pick line 112 has a stopper 300 arranged therein (shown in magnified view in FIG. 3*a*). The stopper 300 is connected to the piston 123 such that it is withdrawn into the pump cylinder 124 when the piston 123 is withdrawn. The stopper 300 is between a first portion of the vacuum forming region, which comprises the pick line 112 and the cylinder 124 (the pick side portion 302) and a second portion of the vacuum forming region (the pump side portion 304). The stopper 300 comprises an elbow-shaped bore 306 therein providing an air passage from a point on one side of the stopper 300 to the end of the stopper 300 within the pick line 112. When the stopper 300 is within the pick line 112, there is a tight fit such that the pick line 112 is capable of sealing the point on one side of the stopper 300 where the bore 306 emerges. The mechanism further comprises an atmosphere pressure sensor 306, which is arranged to provide a measurement of atmospheric pressure to the control circuitry 126.

In this embodiment, whilst the mechanism is waiting for a request for sheet media, the piston 123 is depressed within the cylinder 124. The pick side portion 302 of the vacuum forming region is therefore not in fluid communication with the pump side portion 304. The pump 110 is controlled by the control circuitry 126 to create a partial vacuum in the pump side portion 304. The piston 123 is then drawn back, but only so far that the point on the side of the stopper 300 at which the bore 306 emerges is still inside the pick line 112 and is sealed thereby. Once a request for a sheet media is received, the suction cup 106 is brought into contact with the uppermost sheet in a stack of sheets stored in the cash tray 104 by the control circuitry 126, which then draws the piston 123 and the stopper back further, bring the point at which the bore 306 emerges from the stopper 300 into the piston, opening the bore 306. The air pressure within the pick line 112 rapidly equalizes between the pump side portion 304 and the pick side portion 302 to provide the reduced pressure. It will be appreciated that the pick line 112 is usually thin, almost to the extent of being a capillary tube, where as the volume enclosed by the cylinder 124 is proportionally large. At around the same time, the atmospheric pressure sensor 308 provides the control circuitry 126 with a measurement of atmospheric pressure, which the control circuitry 126 uses to calculate the predetermined target pressure required to hold the sheet media to the suction cup 106.

The pressure sensor 122 determines the pressure within the pick line 112 and compares it with the predetermined target pressure. If the reduced pressure is not a match with the target pressure, the control circuitry 126 causes the motor 120*b* to control the pump 110 which partially evacuates the pick line 112 or pushes forward into the pick line which changes the volume enclosed between the suction cup 106 and the sheet until the predetermined target pressure is reached. Then, the control circuitry 126 stops the pump 110 and drives the gear portion 118 on the rotating disc 116, which moves the suction cup 106 away from the cash tray 104 with the sheet held thereto by suction.

Figure 4:
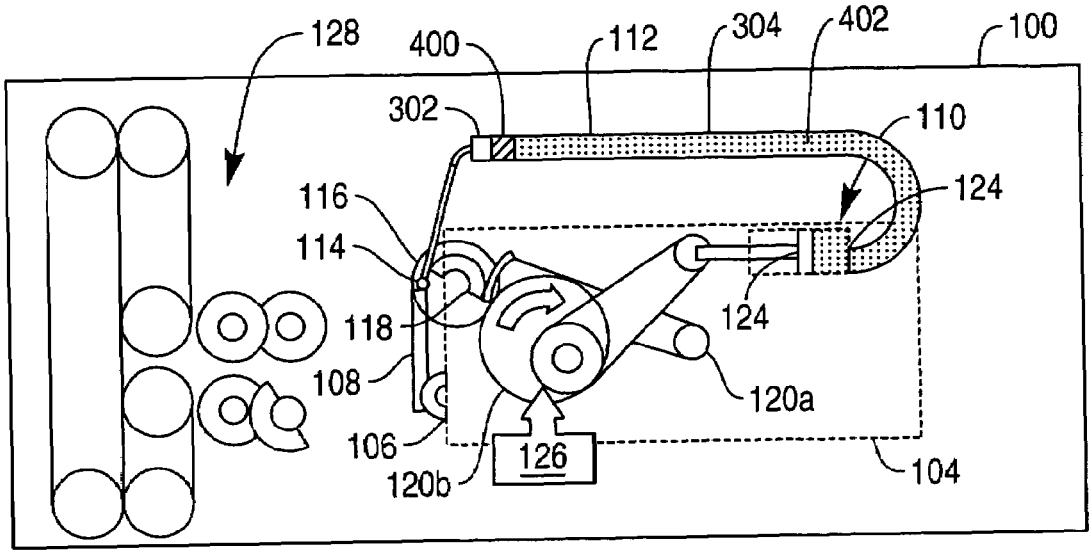
FIG. 4 shows a vacuum pick mechanism according to a third embodiment of the present invention.

In a further alternative embodiment, as shown in FIG. 4, the pick line 112 has a moveable bung 400 arranged therein. The bung 400 defines a first portion of the pick line 112 (the pick side portion 302) and a second portion of the pick line 112 (the pump side portion 304). The pump side portion 304 and the cylinder 124 are filled with fluid 402. The volume which has to approximately double to provide the pressure drop required to attach a sheet to the suction cup 106 is limited to the volume of the pick side portion 302 of the pick line 112 and the volume enclosed by the suction cup 106.

Once a request for a sheet media is received, the suction cup 106 is brought into contact with the front most sheet in a stack of sheets stored in the cash tray 104 by the control circuitry 126. The control circuitry 126 causes the motor 120*b* to control the pump 110 which moves an amount of fluid from the pick line 112 into the cylinder. The volume of the pick side portion 302 of the pick line 112 increases and a partial vacuum is formed therein in the pick side portion 302 and the suction cup 106.

In a modification of this embodiment, a pressure sensor 122 may be used to determine that a predetermined target pressure has been achieved and is maintained.

Alternative embodiments may be readily envisaged which do not depart from the scope of the invention. For example, a sheet media dispenser may be provided with an atmospheric pressure sensor (i.e. a barometer) and the predetermined target pressure may be determined with reference to the instant, or recently measured, atmospheric pressure.

In the event that the pick action fails, i.e. the sheet media is not held securely to the suction cup 106, the mechanism 100 may be arranged such that a new predetermined target pressure is calculated, lower than that used in the previous failed pick attempt and therefore providing a greater pressure difference with the atmospheric pressure.

Leakage pattern recorded by the control circuitry and used to build a pressure profile associated with that type of media can then be used to determine future target pressure. It is also possible that the profile could be used to determine the quality of media being handled and/or to detect an unexpected variation in the media being handled.

APPENDIX

Universal Vacuum Pump

Atmospheric pressure decreases with increasing altitude. It is desired to reduce system pressure by a fixed amount relative to the prevailing atmospheric pressure.

To reduce the system pressure the piston is moved so that a volume expansion takes place. In a typical example:

FullStrokeLength:=0.032 [m]

Take half of the pistons stroke length as the target for attaining the target differential pressure of 0.5[Bar]at altitudes up to 4000 [m]. The remainder of the full stroke will then be available to compensate for leakage.

$$HalfStrokeLength := \frac{FullStrokeLength}{2}$$

[m]

HalfStrokeLength=0.016 and

PistonBoreRadius:=0.016 [m]

Variation in Atmospheric Pressure with Altitude

Consider three example altitudes: 0 m, 2000 m and 4000 m from sea level

AtmosphericPressure_0 m≈$1.1013\cdot10^5$ [N.m^2]

AtmosphericPressure_2000 m≈$0.800\cdot10^5$ [N.m^2]

AtmosphericPressure_4000 m≈$0.620\cdot10^5$ [N.m^2]

$$TargetPressureDifference := \frac{\text{AtmosphericPressure_0m}}{2}[N\cdot m\hat{}-2]$$

TargetPressureDifference:=$5.065\cdot10^4$ [N.m^−2]

MaxSweptVolume:
=π·PistonBoreRadius$^2$·FullStrokeLength [m^3]

So, in this example

MaxSweptVolume:=$2.574\cdot10^{-5}$ [m^3]

$$DeadVolume := MaxSweptVolume\cdot\left(\frac{HalfStrokeLength}{FullStrokeLength}\right)\cdot\left[\frac{1-\left(\frac{TargetPressureDifference}{AtmosphericPressure}\right)}{\left(\frac{TargetPressureDifference}{AtmosphericPressure}\right)}\right][m\hat{}3]$$

DeadVolume_0 m=$1.287\cdot10^5$ [m^3]DeadVolume_0m·$1000^3$=$1.287\cdot10^4$ [mm^3]

DeadVolume_2000 m=$7.457\cdot10^6$ [m^3]

DeadVolume_4000 m=$2.884\cdot10^6$ [m^3]

DeadVolume_4000 m·$1000^3$=$2.884\cdot10^3$ [mm^3]

The maximum pressure difference that can be developed by half stroke piston movement is calculated as:

$$\text{MaxPressure_0m} := \left[1-\left(\frac{1}{\frac{\pi\cdot PistonBoreRadius^2\cdot HalfStrokeLength}{\text{DeadVolume_4000m}}+1}\right)\right]\cdot\text{AtmosphericPressure_0m}$$

$$\text{MaxPressure_0m} = 8.748\cdot10^4[N\cdot m\hat{}-2]\frac{\text{MaxPressure_0m}}{\text{AtmosphericPressure_0m}} = 0.864[\text{Bar}]$$

i.e. at sea level the pump is capable of creating this pressure in half the stroke subject to drive torque availability and assuming no leakage.

The stroke length required to pull the target differential pressure of 0.5 Bar at sea level is calculated as:

$$StrokeLength = \frac{\text{DeadVolume_400m}}{\pi\cdot PistonBoreRadius^2}\left(\frac{\text{AtmosphericPressure_0m}}{0.5\cdot\text{AtmospheriPressure_0m}}-1\right)[\text{m}]$$

StrokeLength_0 m_500 mBar=0.0025282 [m]

i.e.; Piston must be drawn downwards by this amount of attain 0.5 bar pressure difference at sea level (assuming no leakage).

The percentage of available stroke which is used to attain this pressure is:

$$\frac{\text{StrokeLength_0m_500mBar}}{FullStrokeLength}\cdot100 = 7.901[\%]$$

The crank rotation necessary to achieve this piston displacement is calculated as:

$$\theta\text{crank_0m_500mBar} = \left(a\cos\left(\frac{\text{CrankHeight_0m_500mBar}}{LoadGearRadius}\right)\right)[\text{rad}]$$

where

LoadGearRadius:=0.016 [m]

CrankHeight_0 m_500 mBar=LoadGearRadius−StrokeLength_0 m_500 mBar [m]

CrankHeight_0 m_500 mBar=0.0134718 [m]

$$\theta\text{crank_0m_500mBar}\cdot\left(\frac{360}{2\cdot\pi}\right) = 32.649[\text{degrees}]$$

The crank must be rotated by this amount to achieve the required piston displacement.

The acceleration rate required to achieve this angular displacement from rest in t[s]is calculated as $$\alpha := \frac{2\cdot\theta\text{crank_0m_500mBar}}{t^2}[\text{rad}\cdot s\hat{}-2]$$

The angular velocity that would be reached in this time is

Ω:=α.t [rad.s^−1]

The effective lever arm length at this crank angle is

EffectiveLeverLength_0 m_500 mBar:=
$\sqrt{\text{LoadGearRadius}^2-\text{CrankHeight_0m_500mBar}^2}$[m]

The necessary static load gear torque given a maximum spring assistance of m[N]?

m:=10 [N]

$$SpringAssistance := m\cdot\left[1-\left(\frac{\text{StrokeLength_0m_500mBar}}{FullStrokeLength}\right)\right][\text{N}]$$

$$X := (\text{TargetPressureDifference} \cdot \pi \cdot \text{PistonBoreRadius}^2 - \text{SpringAssistance})\ \text{LoadGearTorque_0 m_500 mBar} := X \cdot \text{EffectiveLeverLength_0 m_500 mBar}$$

This is the required load gear torque to move the piston sufficiently to pull 500 [mbar]at sea level.

What is the corresponding motor torque required?

$$\text{MotorTorque_0m_500mBar} := \frac{\text{LoadGearTorque_0m_500mBar}}{GearRatio}\,[N \cdot m]$$

$$\text{MotorTorque_0 m_500 mBar} = 0.063\ [\text{N.m}]$$

This is the required motor torque to move the piston sufficiently to pull 500 [mbar]at sea level.

What is claimed is:

1. A vacuum pick mechanism for picking sheet media items, the vacuum pick mechanism comprising:

a pump;

a suction cup arranged to contact a sheet media item to pick the sheet media item;

a pick line connecting the pump to the suction cup;

a pressure sensor arranged to measure the pressure relative to local atmospheric pressure within the pick line;

a motor arranged to drive the pump; and control circuitry arranged to (i) receive pressure information indicating the pressure measured by the pressure sensor, (ii) monitor the pressure during transport of a first sheet media item, (iii) control the motor to drive the pump until a first predetermined target pressure is measured by the pressure sensor, (iv) control the pump so as to increase pressure if a pressure drop below the first predetermined target pressure is detected during transport of the first sheet media item, (v) record a leakage pattern for the first sheet media item based on pressure changes noted during handling of the first sheet media item, (vi) compute a second predetermined target pressure which is different from the first predetermined target pressure based upon the recorded leakage pattern associated with the first sheet media item, (vii) monitor the pressure during transport of a second sheet media item, (viii) control the motor to drive the pump until the second predetermined target pressure is measured by the pressure sensor, and (ix) control the pump so as to increase pressure if a pressure drop below the second predetermined target pressure is detected during transport of the second sheet media item.

2. A vacuum pick mechanism according to claim 1, wherein the second predetermined target pressure is lower than the first predetermined target pressure.

* * * * *